US006834670B2

(12) United States Patent
Rosine et al.

(10) Patent No.: US 6,834,670 B2
(45) Date of Patent: Dec. 28, 2004

(54) HOSE REEL CART WITH FOLDING CRANK HANDLE

(75) Inventors: Lyle Rosine, Batavia, IL (US); Brian Moon, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 141 days.

(21) Appl. No.: 10/286,668

(22) Filed: Oct. 31, 2002

(65) Prior Publication Data

US 2004/0084084 A1 May 6, 2004

(51) Int. Cl.[7] ..... F16H 75/34

(52) U.S. Cl. ..... 137/355.27; 137/355.26

(58) Field of Search ..... 137/355.26, 355.27

(56) References Cited

U.S. PATENT DOCUMENTS

RE32,510 E * 9/1987 Tisbo et al. ..... 137/355.27

* cited by examiner

*Primary Examiner*—A. Michael Chambers
(74) *Attorney, Agent, or Firm*—McHale & Slavin, P.A.

(57) ABSTRACT

A hose cart allowing preassembly thereby eliminating the need for product packaging necessary of hose carts that are sold in an unassembled state. The hose cart employs a unitary frame for support of a flexible garden hose to be wound into a coil of multiple layers by use of a directional hose reel spool. A crank is provided for rotation of the spool utilizing a collapsible handle for windably holding an elongated flexible garden hose, the crank can be attached to the side of the apparatus allowing left or right hand operation. The pivoting handle can be repeatedly moved from a locked storage position to a locked cranking position. A sleeve is used to allow the handle to be turned within a fixed grip of the operator.

7 Claims, 6 Drawing Sheets

HOSE REEL CART WITH FOLDING CRANK HANDLE

RELATED PATENTS

This application is related to U.S. Pat. Nos. 5,425,391, 5,704,384, and 5,901,730, all of which are incorporated herein by reference.

FIELD OF THE INVENTION

This invention relates to the storage of flexible garden hoses and, more particularly, to an improved portable hose having a folding crank handle that can be alternately moved from a shipping/storage position to an operative position, and a rotatable sleeve that can be secured to the handle.

BACKGROUND INFORMATION

Portable hose reel carts for handling and storage of flexible water hoses, such as garden hoses, have gained wide public acceptance. While the construction of hose reel carts as quite varied, such carts are primarily constructed of molded plastic components having a centrally disposed rotatable spool for reeling of the flexible hose, a frame for supporting of the spool, wheels at one end of the base of the frame, and a frame handle for tilting the frame onto the wheels to facilitate moving the cart. The frame handle may, or may not be foldable for purposes of shipping and/or storage. For more information concerning the structure and operation of hose reel carts, reference may be made to U.S. Patent RE. 32,510, the teachings of which are hereby incorporated by reference.

Hose reel carts are commonly purchased by the consumer wherein it is desirable that the hose reel cart is easily assembled using minimal hand tools. A problem recognized by the assignee, the Suncast® Corporation, is that a majority of the consuming public is unable, or has no desire to assemble such devices. For this reason, the Suncast® Corporation developed foldable and stackable hose reel carts that permit factory assembly, a few of such teachings are disclosed in the previously mentioned patent registrations.

Common to hose reel carts, whether pre-assembled or those that require assembly, is the use of a crank handle that is secured to a hub for use in rotation of the spool. In hose reel carts that are pre-assembled, the crank handle is formed from a unique configuration wherein the crank handle is pivoted from a shipping position to a useable position, namely, perpendicular to the shipping position. The crank handle mounting assembly frictionally engages a shank for permanently locking the handle in the perpendicular or usable position. In this manner, a pre-assembled hose reel cart may be shipped with a crank handle in a folded position to allow stacking of like hose reel carts. Store personnel or the end consumer would then move the crank handle from its shipping position to its usable position. The crank handle would locks into position forming a rigid engagement. Unique to the locked position is that no amount of hand force will allow the crank handle to return to its shipping position. Attempts to return the crank handle to the stored position typically results in damage or breakage of the crank.

Thus, what is lacking in the art is a hose reel cart having a releasable folding crank handle that allows shipping/storage in a folded position, and freedom to pivot into the operative position during use.

SUMMARY OF THE INVENTION

Among the several aspects and features of the present invention may be noted the provision of an improved portable hose reel cart. The hose cart of the present invention is of a shape and design so that the hose cart may be preassembled at the factory thereby eliminating the need for assembly and associated product packaging. Preassembly of the hose reel cart permits the use of a single unitary frame construction for support of a flexible garden hose to be wound into a coil of multiple layers with adjacent turns of each layer touching each other by use of a directional spool rotatably coupled to a frame. The flexible hose is wound around the spool by use of a crank coupled through a hub providing a direct rotational link between the crank and the winding of the spool. During non-use, a handle on the crank is placed in a storage position by pivoting the handle about one end of the crank arm. The crank arm and handle can be positioned on either side of the frame providing a left or right handed operation. The instant invention is directed to an improved crank handle that has a releasable lock for securing the handle in a parallel position with the crank arm for storage and securing the crank handle in a perpendicular position to the crank arm for operation. The crank handle is alternatively movable between the two positions when the lock is released. In addition, a sleeve is provided allowing an operator to rotate the handle with a firm grip.

Thus, an objective of the instant invention is to provide a portable hose reel cart with all components preassembled so as to eliminate the need for assembly by the consumer, yet allow repeatable storage by providing for the use of a moveable crank handle.

Another objective of the instant invention is to disclose the use of a locking tab that allows the crank handle to be locked in either a storage position or an operating position.

Still another objective of the instant invention is to disclose the use of a sleeve friction fit on the handle for relative movement between the handle and the sleeve as the crank is turned.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
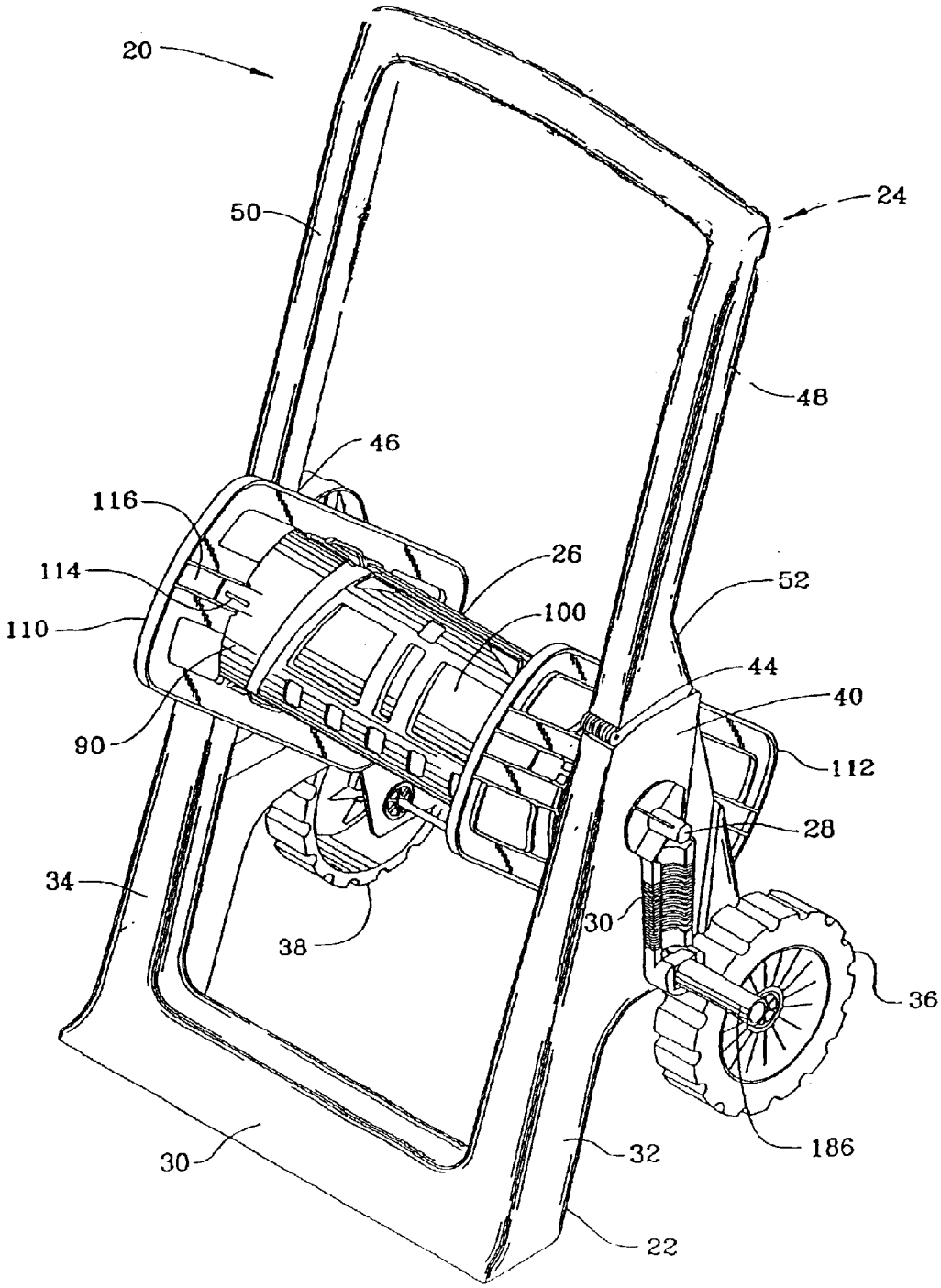
FIG. 1 is a perspective view of a portable hose cart embodying various aspects of the present invention.
Figure 2:
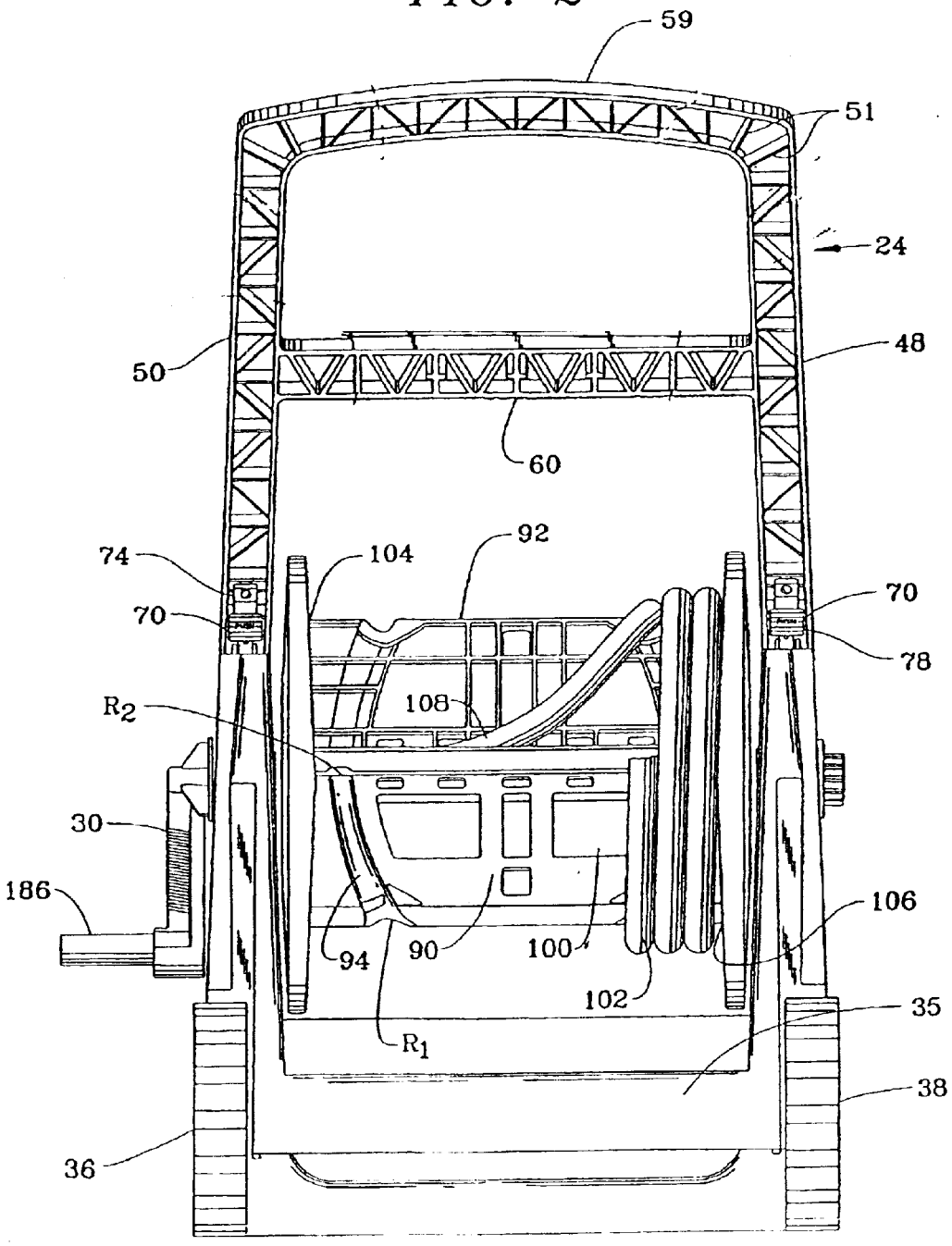
FIG. 2 is a front view, partially in section, of the portable hose cart with the tray in a stored position.
Figure 3:
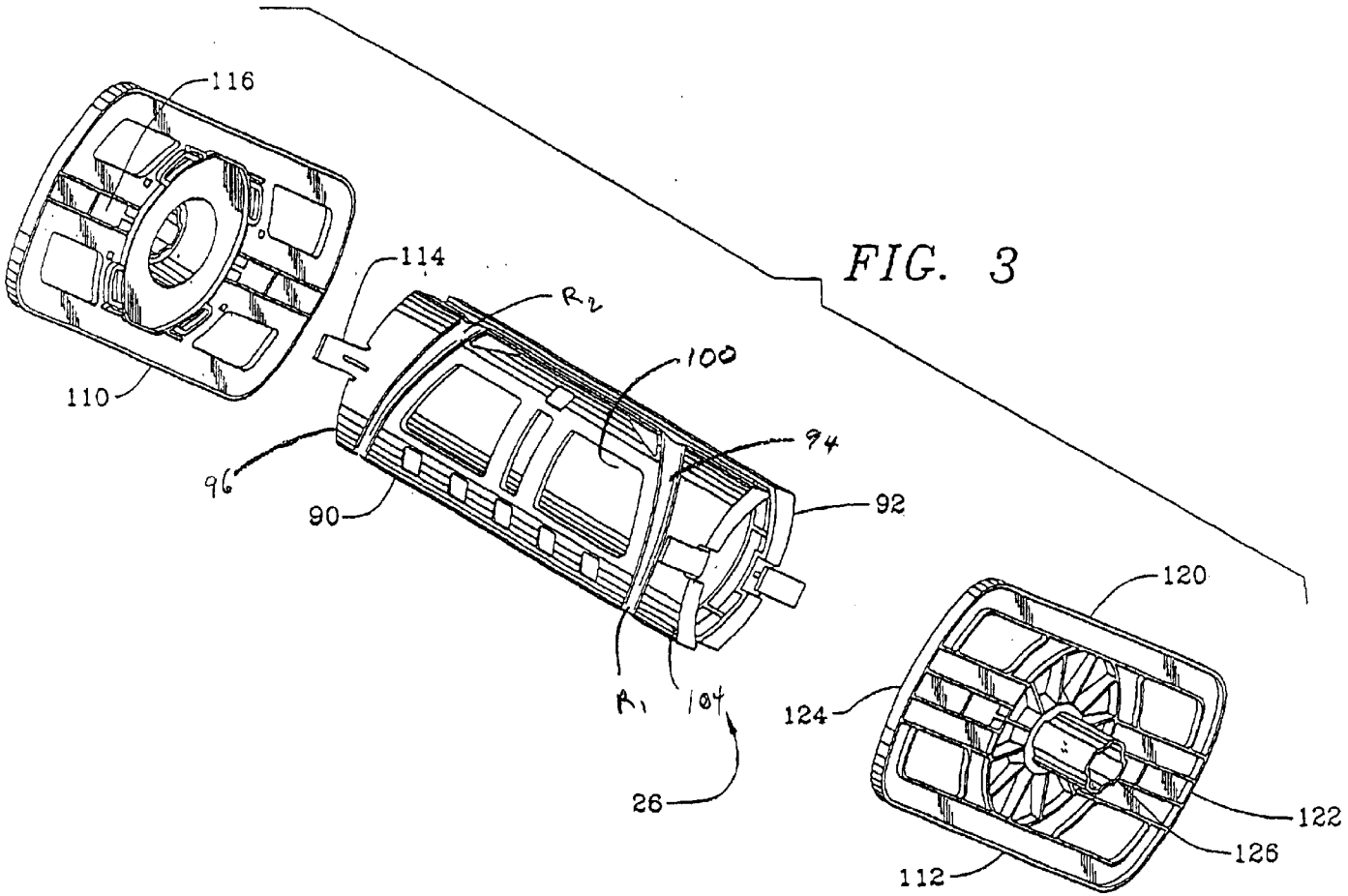
FIG. 3 is an exploded view, partially in section, of the reel.

Referring now to FIGS. 1–3, illustrated is a typical hose reel cart embodying the present invention, generally indicated by numeral 20. The major components of the hose storage apparatus include a frame 22 having a collapsible frame handle 24 supporting a spool 26 rotatably mounted to the frame 22. The spool 26 is rotated by use of a crank 28 coupled to the spool which permits rotating of the spool for purposes of winding a flexible hose onto the cart.

The frame 22 consists of a one-piece molded plastic frame, such as polyethylene, defined by a front crossbar 30 molded to the front legs of inverted V-shaped frame sides 32 and 34. Rear crossbar 35 is molded to the back legs of the frame sides further providing support for wheels 36 and 38 rotatably coupled by axle 37 for ease of transfer by pivoting the weight of the hose reel cart onto the wheels thereby permitting the operator to pull or push the apparatus effortlessly.

Frame sides 32 and 34 form a mirror image and include a hub shape and design allowing for the interchangability of a hub coupling device, namely a crank and hose connector. Upper portion 40 of frame side 32 and an upper portion 42 of frame side 34 is substantially flat with pivot ears 44 and 46 available for connecting to the handle 24. Pivot ears 44 and 46 are formed integrally with said upper portions 40 and 42 of their respective frame sides 32 and 34.

Frame handle 24 is generally U-shaped and constructed of a single piece of plastic with ribbed reinforcement 51 along the rear of the handle. The frame handle 24 is further defined by a pair of lateral bars 48 and 50 each of which have an enlarged base conforming to the upper portions 40 and 42 of the frame 22. Each base includes a pivot ear 56 and 58 operatively associated with the frame pivot ears 44 and 46 allowing pivotable rotation of the handle about the front surface of the frame sides. By release of a locking mechanism 70, the handle is available to pivot about the frame 22 for storage in a flat position against the front surface of frame sides 32 and 34. When the apparatus is not in a storage position, the lifting of the handle 24 into an upright position will engage the locking mechanism 70 causing the handle 24 to lock in an upright position biased against the upper portion of the frames sides. As shown by illustration, the base of the handle is enlarged conforming to the upper portions of the frame sides so that when the apparatus is being transported, the handle provides stability in structure providing leverage ability should undue weight be present.

Locks 70 releasably secure the handle 24 to the frame 22 in an upright position. The lock base is secured to its respective portion of the handle lock screw 74. The lock base has a resilient section formed integral therewith. A push plate 78 is also formed integrally with the resilient section. A lip formed along the bottom end of the lock is available for engaging a respective lock opening formed in the upper portion of each frame side 32 and 34. The bottom of the lip is rounded so as to assist in deflection during the locking stage by sliding over an engagement surface formed on one end of the opening 82 of the frame 22. Further, the placement of the lock within the handle base prevents accidental release of the lock.

Spool 26 is made up of two identically molded cross braces which form reel halves 90 and 92 with a pre-formed hose cavity 94 extending from a first edge 96 to a second edge 98. The cavity forms an inward slope from the first edge 96 inward from side edge 104 to the second edge 98 wherein the cavity 94 is continuous across the surface of the spool and tapers inboard from side edge 104. Openings 100 of sufficient size to receive the hand of an operator allows the operator to thread the female hose end connector of a hose 102 to the male outlet of the hub centrally disposed on the end of the hub found within the spool cavity. Additionally, the separation of the two spool halves 90 and 92 further provide sufficient area allowing the operator to attach the end of a flexible hose to follow the cavity 94 on one side of the reel 90. It should be noted that each spool 90 and 92 have the aforementioned cavities place along each side edge allowing a single piece part application and further allowing the hose to be wrapped in either a clockwise or counter clockwise motion. Further, the winding of the hose can be made from left to right, or reversed, based upon consumer preference movement of the crank to the preferred hub.

The spool halves 90 and 92 are coupled to a pair of spaced apart flanges 110, 112 forming the spool assembly. Flange tabs 114 are insertable into flange opening 116 to secure the components in a fixed predetermined position of which the surface of the spool faces outwardly providing sufficient surface space for winding of a large or long flexible hose. Centrally disposed in each flange is a hub 126 which is insertable into journaled apertures located on the frame 22. The aperture is reinforced by ribs on the inner side of the frame providing reinforcement to the aperture without distracting from the aesthetic appearance of the frame. The ribs are hidden from view once the flanges are installed. The front side of the spool flange includes flange opening 116 disposed between parallel spaced apart support ribs, the opening 116 made available to secure the reel half in a fixed predetermined position. During storage, each flange is set at an angle allowing compact stacking the angular placement of the nesting hose cart. The oblong shape has a first side 118 and second side 120 providing the length and a first end 122 and a second end 124 providing the width. The length and width meet with a curved corner. The inner surface of the hub employs four equal spaced indentations for receipt of hose coupler or crank.

Figure 4:
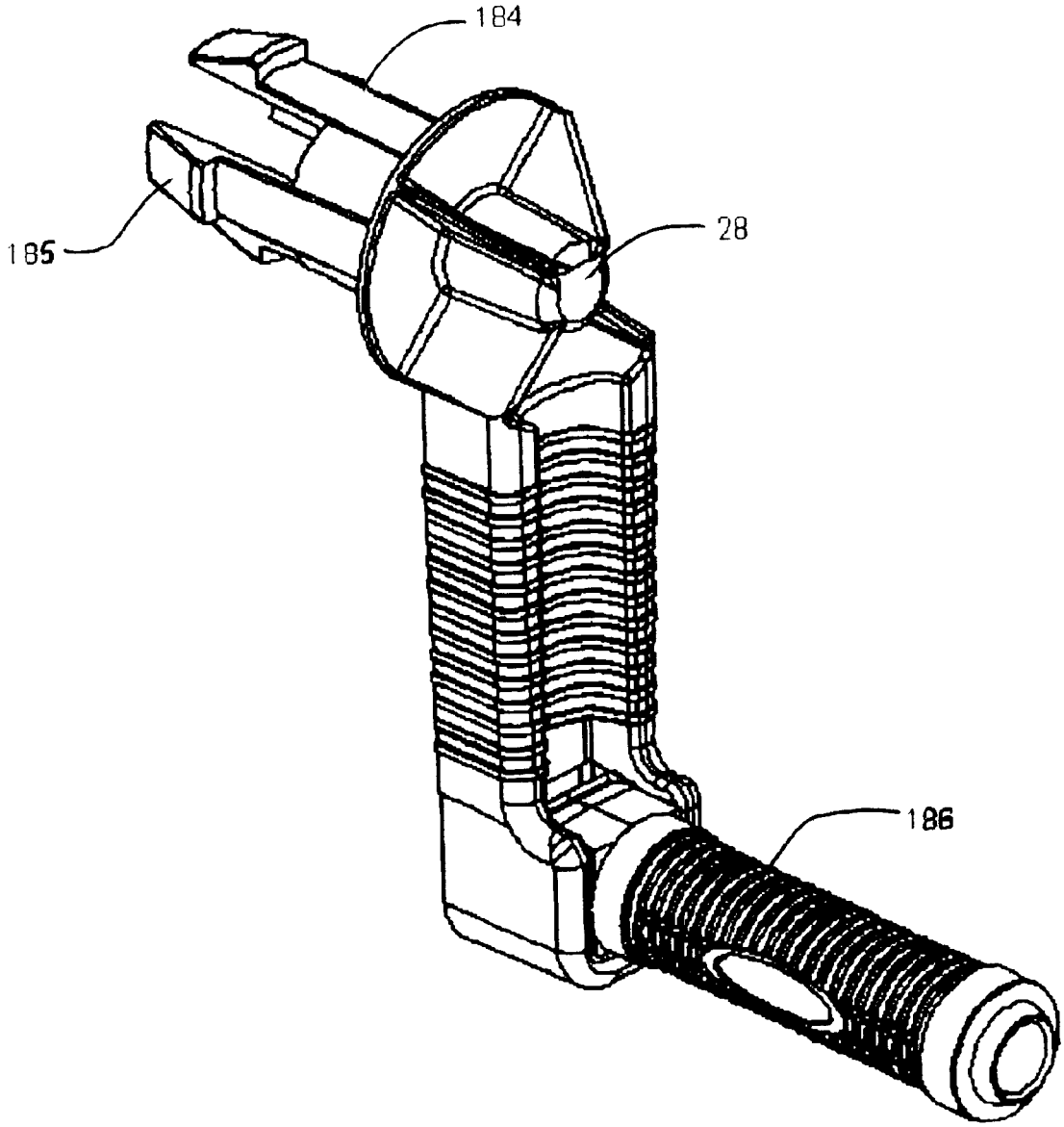
FIG. 4 is a perspective of the folding handle of this invention.
Figure 5:
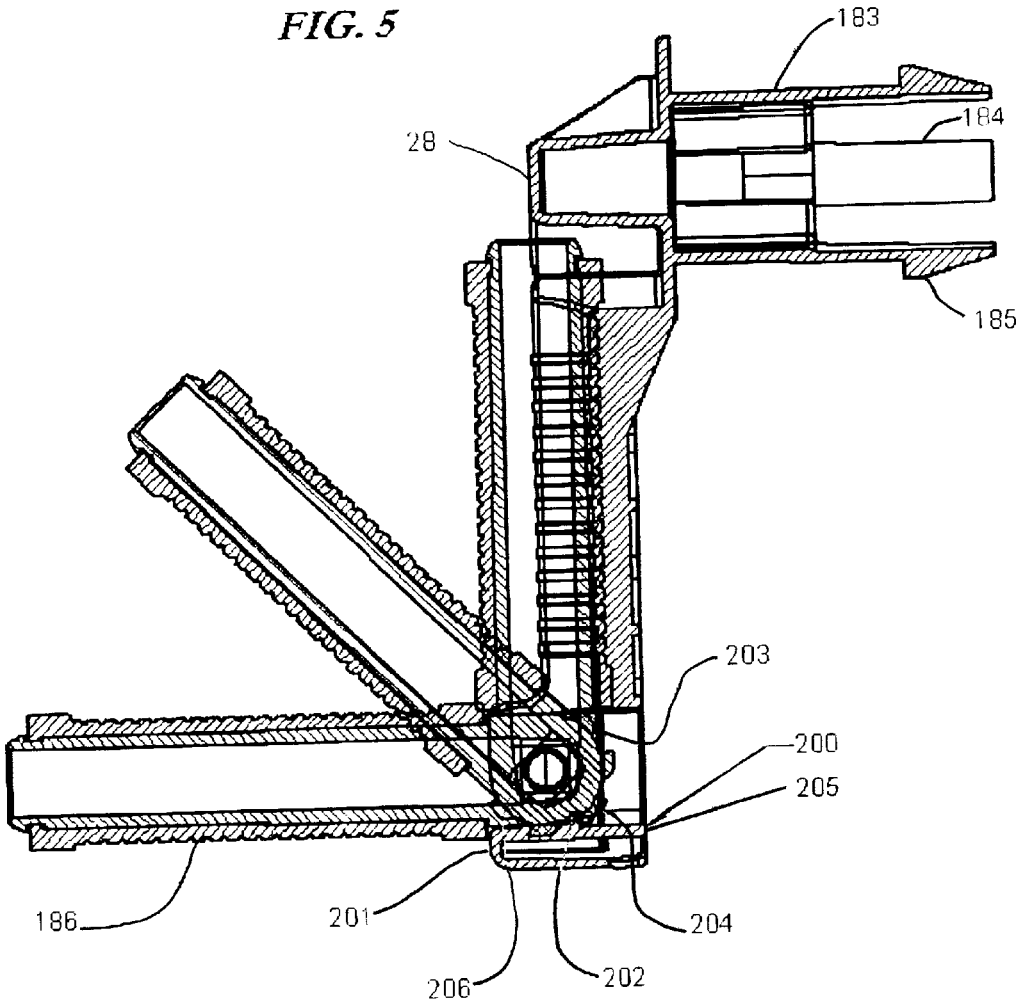
FIG. 5 is a side view, partially in section, of the folding handle of FIG. 4.

As shown in FIGS. 4 and 5, the crank 28 has a split axle 183 which telescopes into hub 126 and resiliently engages the shaped interior with the tangs 181. The crank is held in place by the interrupted flange 185. The axle can be compressed to remove the crank from the reel for placement on the other end of the reel, as desired. The crank arm is formed with an elongated depression along most of its length. The elongated depression is shaped to accept the round handle 186 in the stored position. The handle 186 rotates about pin 206 fixed on the end of the crank and journaled to the end of the handle 186. The connection 200 between the handle and the crank permits repeated lockable movement of the handle 186 from the stacked position to the operative position.

The journaled end of the crank and the end of the handle 186 form a rachet and pawl arrangement. This allows the handle 186 to be temporarily locked in an operative position, as shown in FIGS. 4–5. The rotating end of the handle has detents 203 and 204 that cooperate with the pawl 202 to stop the rotation of the handle and hold it in place. This is done by the resilient living hinge 201 formed integrally with the crank 28. The living hinge has a tang 205 which extends outwardly from the side of the crank for manual operation. By moving the tang 205, the pawl 202 disengages from whichever detent it is contacting and the crank handle 186 position is unlocked. The handle can then be moved to the other position,. By releasing the resilient tang 205 the crank handle 186 is again locked in the new position. While the living hinge is shown between the handle and the end of the crank, it could be placed between the handle and the crank axle. Also, the hinge is shown as an integral living hinge but could be a separate insert of resilient metal or other material.

Figure 6:
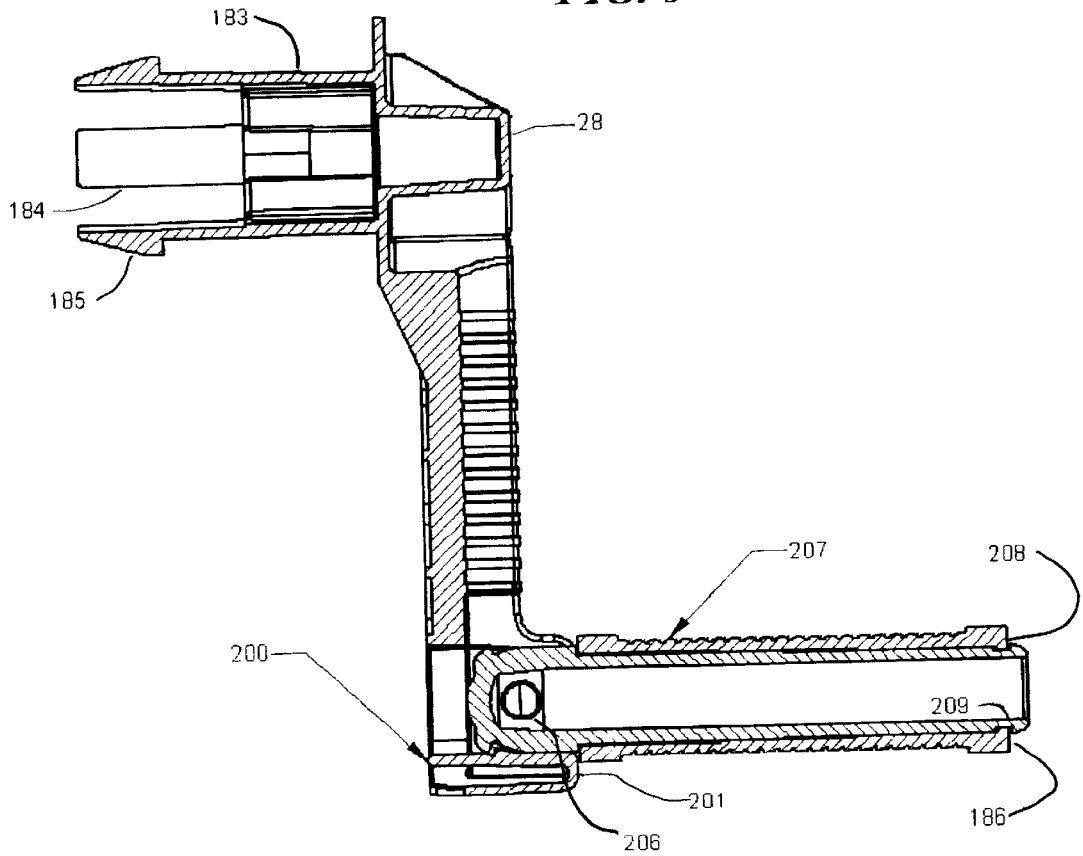
FIG. 6 is a cross section of another embodiment of the folding handle of this invention.

The handle 186, shown FIGS. 4–5, turns in the operator's hand as the reel is manually rotated to wind the hose. As shown in FIG. 6, the handle 186 has a sleeve 207 which turns about the handle to provide a constant gripping surface as the handle is manually rotated to wind the hose. The sleeve 207 is a resilient tubular structure with a inner circumferential flange 208 at the outer end. The flange 208 forms a friction fit with the circumferential groove 209 so that the sleeve and handle can rotate relative to each other. The flange and groove prevent the sleeve from disengaging with the handle. Obviously, these elements could be reversed with the flange on the handle and the groove in the sleeve.

It is to be understood that while we have illustrated and described certain forms of our invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. In a hose storage apparatus for windably holding an elongated flexible garden hose comprising:

a support frame defined by two frame sides each having a top portion with a front leg and a rear leg depending therefrom; a pair of legs journaled to each rear leg; a spool rotatably disposed between said frame sides, said spool having a reel surface for receipt of a flexible hose; a hose connector releasably insertable through one of said frame sides providing an inlet connection fluidly communicated to an outlet extending from said reel surface; a crank releasably insertable through one of said frame sides providing a direct coupling to said spool allowing rotation thereof; the improvement comprising a rotatably mounted handgrip connected to said crank, said rotatable mounted handgrip having a releasable lock assembly, wherein said crank has a resilient locking tab carrying a pawl and said handle has locking detents, wherein said pawl cooperates with said detents to secure said handle in a parallel position with said crank and to secure said handle in a perpendicular position to said crank, said handle movable between said positions when said pawl is released from said detents.

2. The hose reel apparatus of claim 1 wherein said locking tab is connected to said crank by a living hinge.

3. The hose reel apparatus of claim 1 including a sleeve friction fit on said handle for relative movement between said handle and said sleeve as said crank is turned.

4. In a hose storage apparatus for windably holding an elongated flexible garden hose comprising:

a support frame defined by two frame sides each having a top portion with a front leg and a rear leg depending therefrom; a pair of wheels journaled to each rear leg; a spool rotatably disposed between said side frames, said spool having a reel surface for receipt of a flexible hose; a hose connector releasably insertable through one of said frame sides providing an inlet connection fluidly communicated to an outlet extending from said reel surface; a crank releasably insertable through one of said frame sides providing a direct coupling to said spool allowing rotation thereof; the improvement comprising a handgrip rotatably connected to said crank, said handgrip having a sleeve friction fit on said handle for relative movement between said handle and said sleeve as said crank is turned.

5. The hose reel apparatus of claim 4 wherein said handle has a releasable lock, said releasable lock securing said handle in a parallel with said crank and securing said handle in a perpendicular position to said crank, said handle moveable between said positions when said lock is released.

6. The hose reel apparatus of claim 5 wherein said crank has a resilient locking tab carrying a pawl said handle has locking detents cooperating with said pawl to lock said handle in said parallel position and said perpendicular position.

7. The hose reel apparatus of claim 6 wherein said locking tab is connected to said crank by a living hinge.

* * * * *

UNITED STATES PATENT AND TRADEMARK OFFICE

CERTIFICATE OF CORRECTION

PATENT NO. : 6,834,670 B2
DATED : December 28, 2004
INVENTOR(S) : Rosine et al.

It is certified that error appears in the above-identified patent and that said Letters Patent is hereby corrected as shown below:

Column 5,
Line 28, the word "legs" is deleted and the word -- wheels -- is inserted therefor;
Line 37, the phrase -- on a handle -- is inserted after "handgrip"; and
Line 38, "rotatable mounted handgrip" is deleted and -- handle -- is inserted therefor.

Column 6,
Line 25, "handgrip rotatably" is deleted and -- handle -- is inserted therefor;
Line 26, after "said" (first occurrance), the phrase -- handle including a -- is inserted; and
Line 31, the word -- position -- is inserted after "parallel".

Signed and Sealed this

Fourteenth Day of June, 2005

JON W. DUDAS
*Director of the United States Patent and Trademark Office*